United States Patent [19]

Buttner et al.

[11] 4,365,535

[45] Dec. 28, 1982

[54] QUICK RELEASE LOCKING MECHANISM

[75] Inventors: Ronald Buttner, Bellmore, N.Y.; Herbert Dolowich, 905 Grant Pl., North Bellmore, N.Y. 11710; Chaim Zelman, Roslyn, N.Y.

[73] Assignee: Herbert Dolowich, North Bellmore, N.Y.

[21] Appl. No.: 223,705

[22] Filed: Jan. 9, 1981

[51] Int. Cl.[3] ..... G10G 5/00

[52] U.S. Cl. ..... 84/421; 248/412; 403/107; 403/322; 403/351

[58] Field of Search ..... 84/421, 422 C, 422 H; 248/406-407, 411-412; 403/107, 322, 351, DIG. 8

[56] References Cited

U.S. PATENT DOCUMENTS

| | | | |
|---|---|---|---|
| 2,470,256 | 5/1949 | McIlroy | 403/DIG. 8 |
| 2,705,119 | 3/1955 | Ingwer | 248/412 X |
| 3,336,827 | 8/1967 | Gaylor | 84/422 H |
| 4,216,695 | 8/1980 | Hoshino | 84/421 |

*Primary Examiner*—Lawrence R. Franklin
*Attorney, Agent, or Firm*—Natter & Natter

[57] ABSTRACT

A quick release locking mechanism suitable for use as a cymbal retainer includes an adaptor threadably enageable on a cymbal support rod. A collar member adjustably positionable along the adaptor has a tapered socket aperture for accommodating a spherical keeper element. A locking ring surrounding the collar includes a circumferential camming surface rotationally displaceable for selectively urging the spherical element into engagement with the adaptor to secure the collar. An eccentric channel portion provides a pocket for receiving the spherical element to release the collar.

12 Claims, 7 Drawing Figures

QUICK RELEASE LOCKING MECHANISM

BACKGROUND OF THE INVENTION

1. Field of the Invention

This invention relates to fastening devices and more particularly to a releasable locking mechanism.

The locking mechanism of this device is especially adaptable for securing a cymbal to a threaded shaft.

2. Description of the Prior Art

Conventional apparatus for mounting a suspended cymbal generally utilized an adjustable height cymbal rod or post extending from a drum or from a support stand. Cymbals vary in size and shape, however they are generally disc-shaped, bronze alloy or other metallic plates which can be stamped from sheet metal or cast. The approximate size range varies from approximately 13 inches to 22 inches in diameter and they generally have a central cup with a mounting hole approximately 7/16 inch to ½ inch in diameter for placement over the cymbal mounting rod or post. The end of the cymbal rod is frequently provided with a reduced diameter threaded portion, e.g. ¼ inch diameter-20 threads per inch. The threaded portion confronting the central opening is also provided with a protective sleeve of nylon or rubber to prevent metal-to-metal contact.

A similar threaded shaft is also found within a cymbal case or carrier which is used for storing or transporting cymbals.

The most commonly used fastening device for securing the cymbals to the threaded shaft was a wing nut. The nut could be progressively tightened for clamping down on the cymbal to thus firmly hold the cymbal in place and reduce vibrations when played.

The wing nut arrangement previously described was found to be an inconvenience and troublesome to the musician. The repeated necessity for unscrewing the nut to remove the cymbal from the storage case, the reapplication upon mounting the cymbal and the reverse process upon dismounting the cymbal was both a time consuming and annoying procedure. Furthermore, in many instances during a performance vibrations of the cymbal resulted in a loosening of the wing nut which adversely affected the musical characteristics of the instrument.

Several retainer devices were introduced in an attempt to alleviate this problem. Some of these cymbal retainers included snaps, rubberized holders, oblong keeper bars or flared retaining heads, such as disclosed in U.S. Pat. Nos. 3,336,827, 2,163,949, 3,705,528, and 3,994,198. A shortcoming of these prior devices was that they did not provide a positive locking arrangement and adjustable clamping action for choking down upon the cymbal. An attempt to alleviate these disadvantages by providing a retainer having a spring urged ball detent proved likewise successful in dampening the cymbal when played as the upwardly directed forces during vibration were sufficient to overcome the spring force holding the ball within the detent. The use of a stiffer spring made removal of the retainer too difficult.

The positive locking feature and quick release of the instant invention remedy these problems and further have other applications for holding cymbals. In this connection, reference is made to hand-held cymbals such as used by marching bands and drum corps. These cymbals usually come in matched pairs and are provided with leather hand straps or thongs which pass through grommetted center holes in the cymbals to provide a handle. The leather strap, when placed through the hole, was tied or otherwise anchored to the cymbal. A difficulty with that arrangement was that the leather did eventually work loose and become detached from the cymbal. Furthermore, because of stretching or deterioration of the leather, periodic replacement of the straps was required.

The instant invention, in contrast, does not utilize leather straps; instead a threaded shaft is affixed to a suitable handle of wood, plastic or similar material. The cymbal can be secured to a projecting portion of the shaft using the releasable fastener of this invention.

Another shortcoming of the prior art related to the protective sleeve which was formed of nylon or rubber material and slid over the threaded shaft portion confronting the cymbal. This type of sleeve was found deficient in providing a durable surface which could withstand the repeated rubbing contact with the edge surface surrounding the central opening of the cymbal and eventually wore out and required replacement. The present invention utilizes a thermoplastic material formed as an integral part of the adaptor. The material used has superior mechanical properties for reduced wear.

It will hereafter be apparent that the invention provides a releasable locking mechanism which fulfills the shortcomings of the prior art.

SUMMARY OF THE INVENTION

Briefly, the nature of this invention concerns an accessory device for facilitating the set-up and take-down of cymbals.

The purpose of this invention is to provide a versatile improved locking mechanism with quick release features.

Basically, the present invention includes an adaptor having an internally threaded bore at one end for securement to a standard threaded cymbal rod. A surface portion of the adaptor is provided with circumferential fluting or annular grooves for receiving a spherical locking element. The spherical element is projectable through a bore within a collar positioned around the adaptor. A locking ring surrounding the collar has a central opening forming a camming surface in communication with the spherical element. Rotation of the locking ring effects a camming action for selectively urging the spherical element to project through the bore and into engagement with an annular groove of the adaptor. In order to release the collar for removing the cymbal, all that is required is to rotate the locking ring to a position wherein an elongated or eccentrically formed channel within the central opening is in registration with the spherical element. The combination of an upward pressure upon the collar and the curved annular grooved surface is sufficient for moving the spherical element into the eccentric channel, thus providing sufficient clearance for removal of the collar from the adaptor.

It should be noted that the collar can be adjustably positioned downwardly along the adaptor for dampening cymbal vibrations when played.

In view of the foregoing, it should be apparent that the present invention overcomes many of the shortcomings of the prior art devices and provides an improved quick release locking mechanism which eliminates many of the problems previously encountered.

Having thus summarized the invention, it will be seen that it is an object thereof to provide a quick release locking mechanism of the general character described herein which is not subject to the aforementioned disadvantages.

Specifically, it is an object of this invention to provide a quick release locking mechanism for securing a cymbal or similar device to a threaded shaft.

A further object of this invention is to provide a quick release locking mechanism utilizing a spherical element and a camming surface for displacing the element into locking engagement.

An additional object of the present invention is to provide a quick release locking mechanism including an adaptor having plural annular grooves for selectively receiving the spherical element.

A still further object of this invention is to provide a quick release locking mechanism which can be adjustably positioned for suppressing cymbal vibration.

Yet another object of this invention is to provide a quick release locking mechanism of the general character described which is simple in construction, low in cost, reliable in use and well adapted for mass production fabrication techniques.

Other objects of the invention in part will be apparent and in part will be pointed out hereinafter.

With these ends in view, the invention finds embodiment in certain combinations of elements and arrangements of parts by which the objects aforementioned and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which is shown a possible exemplary embodiment of the invention.

DESCRIPTION OF THE PREFERRED EMBODIMENT

Figure 1A:
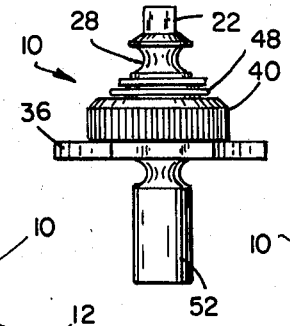
FIG. 1A is a perspective view to an enlarged scale of the quick release locking mechanism.
Figure 1:
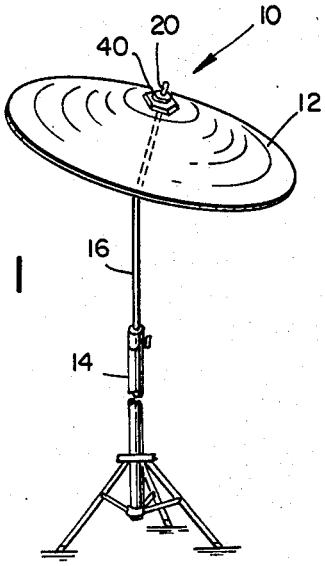
FIG. 1 is a perspective view showing a cymbal stand and a suspended cymbal attached thereto with a quick release locking mechanism of this invention.

Referring now in detail to the drawings, the reference numeral 10 denotes generally a quick release locking mechanism of this invention. The locking mechanism 10, as illustrated in FIG. 1, is shown in a typical application in conjunction with a suspended cymbal 12 secured to a cymbal stand 14. As previously indicated, the locking mechanism 10 of this invention can generally be used for securing any cymbal to any threaded shaft and for that purpose is suitable for securing a hand-held cymbal to a handle having an extended threaded shaft or for securing one or more cymbals to a projecting threaded shaft within a conventional cymbal carrying case. The exemplary embodiment herein, however, will be described with regard to a typical application wherein the suspended cymbal 12 is secured to the cymbal stand 14. The cymbal stand 14 generally includes a telescopically adjustable cymbal rod 16 approximately $\frac{3}{8}$ inch in diameter having a reduced threaded end portion 18.

The locking mechanism 10 is provided with an adaptor 20 having a square head 22 at its upper end and internally threaded bore 24 at the distal end for accommodatingly receiving the threaded end 18 of the cymbal rod 16. As a matter of convenience, the square head 22 is dimensioned for accepting a conventional socket drum key 26 for securing and/or removing the adaptor 20 from engagement with the threaded end 18. The drum key 26 is readily available and ordinarily used by the musician for tightening a drum head.

A portion of the adaptor 20 is provided with a plurality of uniformly spaced annular grooves 28. The annular grooves 28 have a complementary contoured curvilinear surface for co-action with a keeper member such as a spherical element 30. The spherical element 30 is preferably a steel ball which is housed within a tapered socket aperture 32 formed within a collar member 34. As noted in FIG. 2, the diameter of the socket aperture 32 at its tapered end is slightly less than the diameter of the spherical element 30 and in such proportion that the spherical element 30 will partially project within the collar member 34.

The collar member 34 is comprised of a tubular segment having a flange 36 at a lower end being substantially normal thereto and has an annular recess 38 located at an upper end. The flange 36 provides a planar receiving surface for positioning a locking ring 40. The locking ring 40 has a central opening 42, the inside diameter of which corresponds to the outside diameter of the collar member 34 to provide a snug yet slidable fit such that the locking ring 40 is rotatable about the collar member 34. The circumferential surface 44 of the locking ring is scored or knurled to provide a frictional grip to facilitate rotating the ring 40.

The lower surface of the central opening 42 corresponding to and registrable with the tapered socket aperture 32 is provided with an eccentric channel portion 46. The eccentric channel portion 46 is adapted for accommodatingly receiving the spherical element 30 to permit the releasable withdrawal of the adaptor 20.

The locking ring 40 is secured to the collar member 34 by a flat circular spring clip 48 which is seated within the annular recess 38 and provides a projecting lip or edge for retaining the locking ring 40 in position.

The locking ring 40 can further be provided with an index 50 or other indicia corresponding to the location of the eccentric channel 46 thus indicating the rotational orientation for releasing the adaptor 20.

Figure 2:
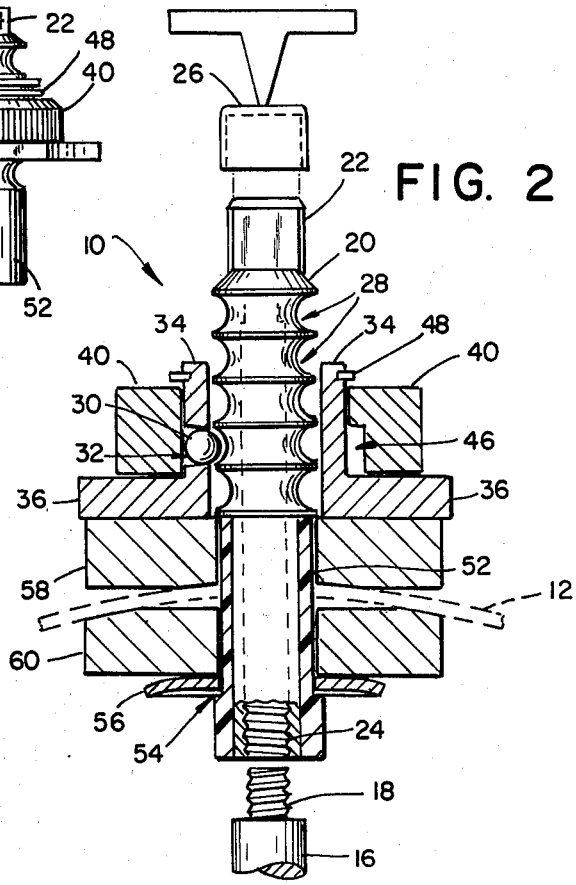
FIG. 2 is a sectional view to an enlarged scale showing the quick release locking mechanism in operative position wherein the cymbal is clampingly received between a pair of felt washers; a drum key is also shown for illustrating the manner in which the locking mechanism can be threadably affixed to a cymbal rod.
Figure 3:
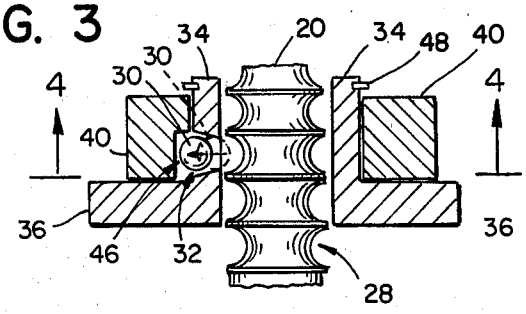
FIG. 3 is a partial sectional view corresponding to the view shown in FIG. 2 further illustrating the manner in which the quick release locking mechanism can be released by displacement of a spherical element from the locked position (indicated in phantom lines) within an annular groove to a released position (indicated by arrow) within an eccentric channel portion of a rotatable locking ring.
Figure 6:
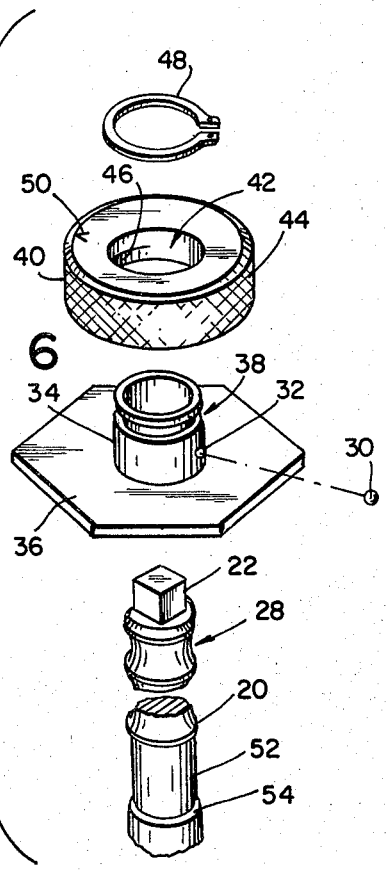
FIG. 6 is an exploded perspective view of the quick release locking mechanism with the felt washers and a support disc omitted for clarity and shows the relationship of the component parts.
Figure 4:
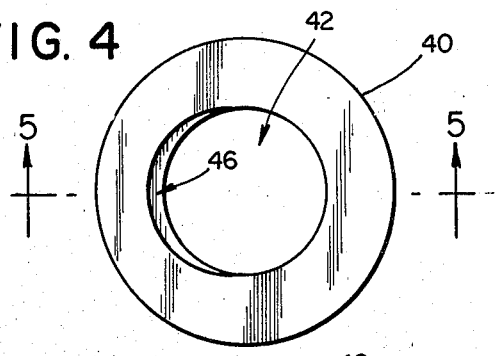
FIG. 4 is a sectional view taken substantially along line 4—4 of FIG. 3 and shows the eccentric channel portion formed within the rotatable locking ring.
Figure 5:
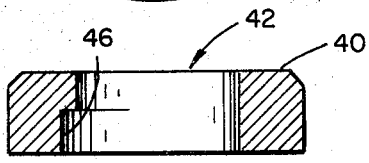
FIG. 5 is a sectional view taken substantially along line 5—5 of FIG. 4 and further illustrates the locking ring and the eccentric channel portion forming a pocket for cooperatively receiving the spherical element.

The adaptor 20 is preferably fabricated of stainless steel or similar durable material. A feature of this invention, however, concerns that portion of the adaptor 20 which is in contact with the cymbal 12. A protective bushing or sleeve 52 is applied to the adaptor 20. It has been found that a thermoplastic material sold under the trademark Delrin provides a more durable surface than Nylon or other plastic materials and will sufficiently insulate the cymbal 12 from contact with the metallic adaptor 20. Furthermore, as illustrated in FIG. 2, the protective sleeve 52 can include a shoulder portion 54 for supporting a metal disc or washer 56. The washer 56 can also be press-fit around the sleeve 52 or otherwise supported on the rod 16. In addition, a pair of felt washers 58, 60 on opposite sides of the cymbal 12 provide cushioned contact.

In operation, the quick release locking mechanism 10 of this invention is secured to the threaded end 18 of the cymbal rod 16 by use of the drum key 26 which is applied to the square head 22 of the adaptor 20. The support disc 56 is next positioned over the adaptor 20 and will rest upon the shoulder portion 54 of the protective sleeve 52. A felt washer 60 is then placed on top of the support disc 56 and the cymbal 12 is positioned on the felt washer 60. The additional felt washer 58 is then placed on top of the cymbal 12 and the pre-assembled collar member 34, and the locking ring 40 secured by the clip 48 is placed over the adaptor 20. It should be noted that the locking ring 40 should first be registered so that the eccentric channel portion 46 confronts the spherical element 30. Downward pressure can then be applied to displace the flange 36 for effectuating the desired dampening action upon the cymbal 12. Next the locking ring 40 is rotated approximately 60 degrees whereby the circumferential wall of opening 42 acts as a camming surface for urging the spherical element 30 into the tapered socket opening 32. The spherical element 30 will partially project through the opening 32 for engagement within one of the plurality of annular grooves 28. If it is desired to decrease the dampening effect or to otherwise remove the collar member 34, the locking ring 40 is rotationally displaced approximately 60 degrees such that the eccentric channel 46 is again in confronting relationship with the spherical element 30. The collar member 34 can then be moved upwardly along the adaptor 20 for releasing the cymbal 12.

Thus, it will be seen that there is provided a quick release locking mechanism which achieves the various objects of the invention and which is well adapted to meet the conditions of practical use.

Since various possible embodiments might be made of the present invention and further changes might be made in the exemplary embodiments set forth herein, it is to be understood that all material set forth or shown in the accompanying drawings is to be interpreted as illustrative and not in a limiting sense.

Having thus described the invention, there is claimed as new and desired to be secured by Letters Patent:

1. In a cymbal mounting arrangement including a cymbal rod having a threaded end, a cymbal having a central opening for passage of the cymbal rod and support means for suspending the cymbal on said rod, the improvement comprising a quick release locking mechanism, said locking mechanism having an adaptor threadably engageable on said cymbal rod, a collar member slidably mounted on said adaptor, said collar member including an aperture for seating a locking ball, a ring member rotationally displaceable about said collar member, said ring member including a camming surface for selectively urging said locking ball toward the adaptor for interlocking engagement therewith to thus secure the collar at selected locations along the adaptor for adjustable cymbal vibration dampening.

2. A quick release locking mechanism as claimed in claim 1 wherein the ring member includes a recessed surface area selectively registrable with the locking ball for releasing the collar member.

3. A quick release locking mechanism for removably mounting a cymbal to a support comprising an adaptor member extendible through a central opening in said cymbal, a collar member surrounding said adaptor member and slidably positionable therealong, said collar member including an aperture in a wall and providing communication with said adaptor member, a keeper element accommodatable within said aperture, a ring member circumscribing said collar member and in confronting relationship with said keeper element, said ring member further having a camming surface, said ring member being rotationally displaceable about said collar member with the camming surface contacting and urging the keeper element toward the adaptor member, said adaptor member defining a plurality of spaced annular ridges for receiving said keeper element at incremental ridge locations therealong whereby the collar member can be adjustably positioned against the cymbal and releasably secured by the rotatable ring member.

4. A quick release locking mechanism as claimed in claim 3 wherein the ring member has a central opening with the circumferential wall of said opening providing said camming surface.

5. A quick release locking mechanism as claimed in claim 4 wherein a portion of said circumferential wall defines an eccentric channel.

6. A quick release locking mechanism as claimed in claim 5 wherein the eccentric channel is selectively registrable with the keeper element, the eccentric channel further providing a recess for accommodating the keeper element to release the collar member.

7. A quick release locking mechanism as claimed in claim 6 wherein the collar member includes a tapered aperture, said aperture being adapted for accommodatingly receiving said keeper element with a portion of said keeper element being projectable through a tapered end of said aperture.

8. A quick release locking mechanism as claimed in claim 7 wherein the collar member includes a tubular segment having a flange for receiving and positioning the ring member.

9. A quick release locking mechanism as claimed in claim 8 wherein a portion of the adaptor in confronting relationship with the cymbal includes an integral protective sleeve of a thermoplastic material, said sleeve further including retainer means for supporting the cymbal.

10. A quick release locking mechanism as claimed in claim 9 wherein the upper end of the adaptor is provided with a square head which can be engaged by a conventional drum key.

11. A quick release locking mechanism as claimed in claim 10 wherein the collar member is provided with an annular groove and clip means for engaging the annular groove to secure the ring member to the collar member.

12. A quick release locking mechanism as claimed in claim 11 wherein the keeper element is spherical.

* * * * *